United States Patent [19]

Yerushalmi

[11] 4,433,522

[45] Feb. 28, 1984

[54] BLAST AND FRAGMENT-RESISTANT PROTECTIVE WALL STRUCTURE

[75] Inventor: Yaakov Yerushalmi, Petach Tikva, Israel

[73] Assignee: Koor Metals Ltd., Bat-Vam, Israel

[21] Appl. No.: 250,578

[22] Filed: Apr. 3, 1981

[30] Foreign Application Priority Data

Apr. 13, 1980 [IL] Israel ..... 59817

[51] Int. Cl.[3] ..... E04B 2/32; E04B 2/86

[52] U.S. Cl. ..... 52/426; 52/249; 52/562; 52/588

[58] Field of Search ..... 52/426, 562, 422, 425, 52/588, 249

[56] References Cited

U.S. PATENT DOCUMENTS

| | | | |
|---|---|---|---|
| 1,035,206 | 8/1912 | Lewen | 52/426 X |
| 2,062,724 | 12/1936 | Olsen | 52/422 |
| 3,238,681 | 3/1966 | Vivio | 52/588 X |
| 3,321,884 | 5/1967 | Klaue | 52/426 X |
| 3,440,785 | 4/1969 | Denny et al. | 52/426 X |
| 3,555,751 | 1/1971 | Thorgusen | 52/426 X |

FOREIGN PATENT DOCUMENTS

| | | | |
|---|---|---|---|
| 1299616 | 6/1962 | France | 52/426 |

*Primary Examiner*—Alfred C. Perham
*Attorney, Agent, or Firm*—Benjamin J. Barish

[57] ABSTRACT

A protective wall structure having a high resistance to blast and fragments includes two spaced groups of panels of sheet metal in interlocking relationship and defining each of the two opposite faces of the wall structure, a plurality of diagonal panels extending diagonally in saw-tooth configuration between the face panels and in interlocking relationship with them, and a filling material of concrete or asphalt filling the space between the face panels and embedding the diagonal panels therein.

10 Claims, 12 Drawing Figures

FIG. 8
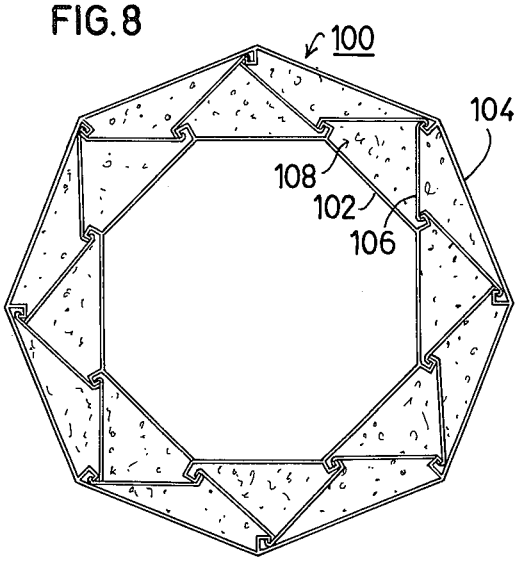
FIG. 7
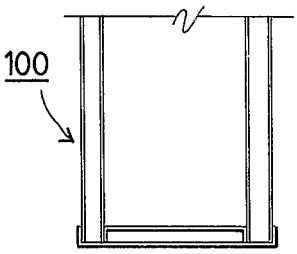
FIG. 9
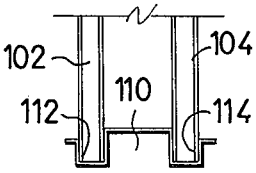
FIG. 11
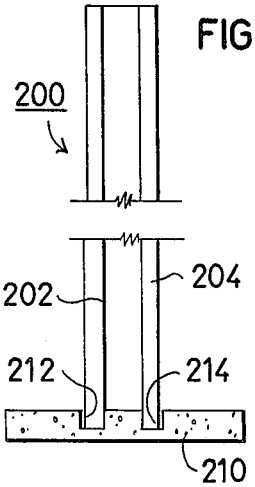
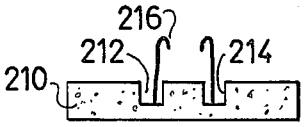
FIG 12
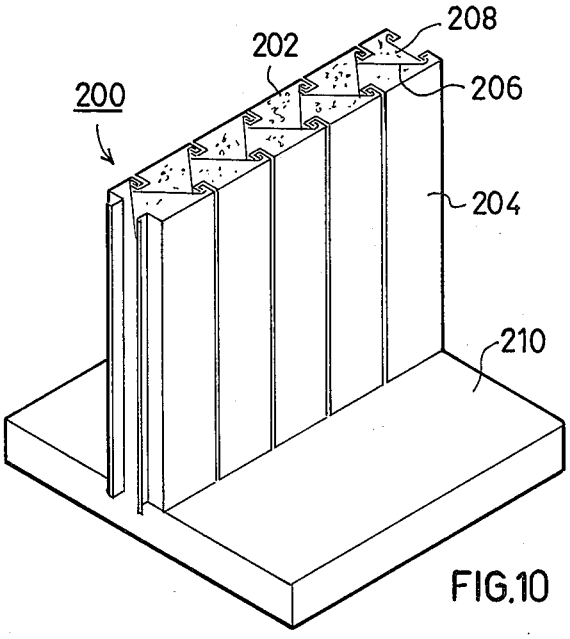
FIG. 10

BLAST AND FRAGMENT-RESISTANT PROTECTIVE WALL STRUCTURE

BACKGROUND OF THE INVENTION

The present invention relates to protective wall structures, and particularly to wall structures having a high resistance to blast and fragments such as are used in bomb shelters and the like.

Reinforced concrete is commonly used in making such protective wall structures, but because of the low tensile strength of concrete, its low ability to absorb energy, and its tendency to crumble upon impact, such reinforced concrete walls are usually made extremely thick, in the order of 40–60 cm. Another type of protective wall has been devised, commonly called a "lacing steel" wall, including concrete reinforced with a lacing steel secured to the reinforcement rods. However, such a protective wall is extremely costly to produce; moreover, it does not have a high resistance to fragments.

BRIEF SUMMARY OF THE INVENTION

An object of the present invention is to provide a novel protective wall structure having advantages in the above respects.

According to the present invention, there is provided a protective wall structure having a high resistance to blast and fragments, and including two spaced groups of panels of rigid metal sheets, such as steel, the sheets of each group having ends in interlocking relationship with the ends of the adjacent sheets of the respective groups, and defining therewith each of the two opposite faces of the wall structure. The interlocking ends of one group of face panels are non-aligned with those of the other group of face panels, so as to enable them also to interlock with the ends of a plurality of diagonal panels of rigid metal sheets, such as steel, extending diagonally between the face panels, the ends of the diagonal panels being in interlocking relationship with each of the interlocking ends of the face panels. A filling material, such as concrete or asphalt, is introduced to fill the space between the face panels and to embed the diagonal panels therein.

In the preferred embodiment described below, the face panels are formed with stepped, inwardly-bent ends, which ends of adjacent panels are in nesting interlocking relationship with each other and with the ends of the diagonal panels. Also, the diagonal panels are formed with stepped ends and are disposed in a saw-tooth configuration coming together in nesting relationship with the stepped bent ends of the face panels.

It has been found through actual tests that protective wall structures constructed in accordance with the foregoing features provide a high degree of resistance to fragments and also to blast, and may therefore be built of considerably smaller thickness than the conventional reinforced-concrete protective walls. In addition, their resistance to fragments is considerably higher than that of the "lacing steel" construction, and moreover, they can be built at considerably lower cost than that construction.

Further features and advantages of the invention will be apparent from the description below.

BRIEF DESCRIPTION OF THE DRAWINGS

The invention is herein described, somewhat diagrammatically and by way of example only, with reference to the accompanying drawings, wherein:

FIG. 7 is a front elevational view illustrating a blast container constructed in accordance with the invention;

FIG. 8 is an enlarged top plan view of the blast container of FIG. 7;

FIG. 9 is an enlarged fragmentary view illustrating the structure of the foundation for supporting the blast container of FIG. 7;

FIG. 10 is a three-dimensional view illustrating another wall structure constructed in accordance with the invention and supported on a concrete foundation;

FIG. 11 is an end elevational view of the wall structure of FIG. 10; and FIG. 12 illustrates the construction of the foundation for the wall structure of FIG. 10.

DESCRIPTION OF PREFERRED EMBODIMENTS

Briefly, the wall structure illustrated in FIGS. 1–6 comprises a first group of sheet-metal face panels 2 defining one face or skin of the wall, a second group of sheet-metal face panels 4 defining the other face or skin of the wall, a plurality of diagonal panels 6 extending diagonally between the face panels 2 and 4, and filling material 8, preferably of concrete or asphalt, filling the space between the face panels 2 and 4 and embedding the diagonal panels 6 therein.

Figure 3:
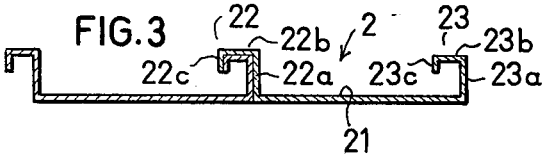
FIG. 3 is an enlarged, end elevational view illustrating two interlocked panels included in the facing or skin of the wall structure of FIGS. 1 and 2.

The face panels 2 and 4 are all of the same configuration, as best seen in FIG. 3. Each face panel includes a main section 21 terminating at each end 22, 23 in three right-angle bends extending inwardly of the panel, i.e. towards the opposite face panel. Thus, end 22 includes the three right-angle bends **22*a*, 22*b*, 22*c*, and end 23 includes the three right-angle bends 23*a*, 23*b*, 23*c*. These bends at both ends are in the same direction, so that the free leg 22*c* is disposed in front of the main section 21 of the panel, whereas the free leg 23*c* overlies the opposite end of the main section of the panel. Also, the dimensions of the three bends at end 22 are slightly larger than those at end 23**, so as to permit the bends at the latter end of one panel to be nested within the bends at the former end of the adjacent like panel, thereby enabling a plurality of panels to be assembled in interlocking relationship with respect to each other.

Figure 4:
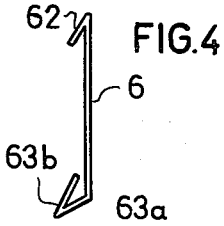
FIG. 4 is an end elevational view illustrating one of the diagonal panels included in the wall structure of FIGS. 1 and 2.
Figure 5:
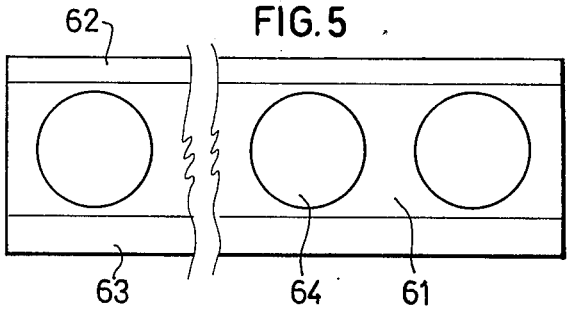
FIG. 5 is a front elevational view illustrating the diagonal panel of FIG. 4.

The diagonal panels 6 are also all of the same configuration, as best seen in FIGS. 4 and 5. Each includes a main panel section 61 terminating in an acute-angle bend 62 at one end, and in a double-bend 63 at the opposite end. The inner bend 63*a* of the double-bend 63 forms an obtuse angle with respect to the main panel section 61, whereas the outer bend 63*b* forms an acute angle to the inner bend 63*a*.

In addition, the main panel section 61 of the diagonal panels 6 are formed with openings 64 (FIG. 5) to permit the passage therethrough of the filling material 8.

Figure 6:
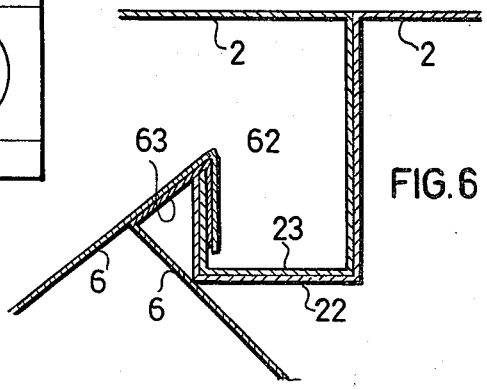
FIG. 6 is an enlarged, end elevational view illustrating the interlocking arrangement between the face panels and the diagonal panels in the wall structure of FIGS. 1 and 2.

FIG. 6 best illustrates the manner in which a plurality of the panels 2, 4, and 6 are all interlocked with respect to each other to form the two faces of the wall structure and the diagonals inbetween. Thus, with respect to the interlocking of the face panels 2 and 4, it will be seen that end 23 of one face panel is received within the opposite end 22 of the next adjacent face panel, so that the main panel sections 21 of all the face panels at that side of the wall structure are substantially flush with each other, with the interlocking ends extending inwardly towards the panels of the other face. With respect to the interlocking of the diagonal panels 6, the double-bend end 63 of one such panel is received over the nested free legs 22*c*, 23*c* of the respective face panels, and extends at a diagonal in one direction; whereas the single-bend end 62 of another such panel 6 is received over the latter legs and extends also diagonally between the two groups of face panels 2, 4, but at about a 90° angle to the previously-mentioned diagonal panel 6. The diagonal panels 6, thus interlocked with each other and with the face panels 2, 4, extend in a saw-tooth configuration between the face panels.

After the two groups of face panels 2 and 4, and the diagonal panels 6, have all been assembled together in interlocking relationship as described above, a filling material, preferably concrete, is poured to fill the space between the two groups of face panels 2, 4, and also to embed the diagonal panels 6. The openings 64 through the diagonal panels 6 permit the concrete to pass between and to completely fill this space.

As one example, all the panels 2, 4 and 6 may be of steel of 0.6 mm thickness; the length of each face panel 2, 4 may be about 25 cm, and the spacing between them, defining the thickness of the wall structure, may also be about 25 cm. At end 22, leg 22*a* may be about 6 cm, leg 22*b* may be about 5 cm, and leg 22*c* may be about 2 cm, with the corresponding legs at the opposite end 23 being slightly smaller to permit nesting within the legs at end 22.

Figure 1:
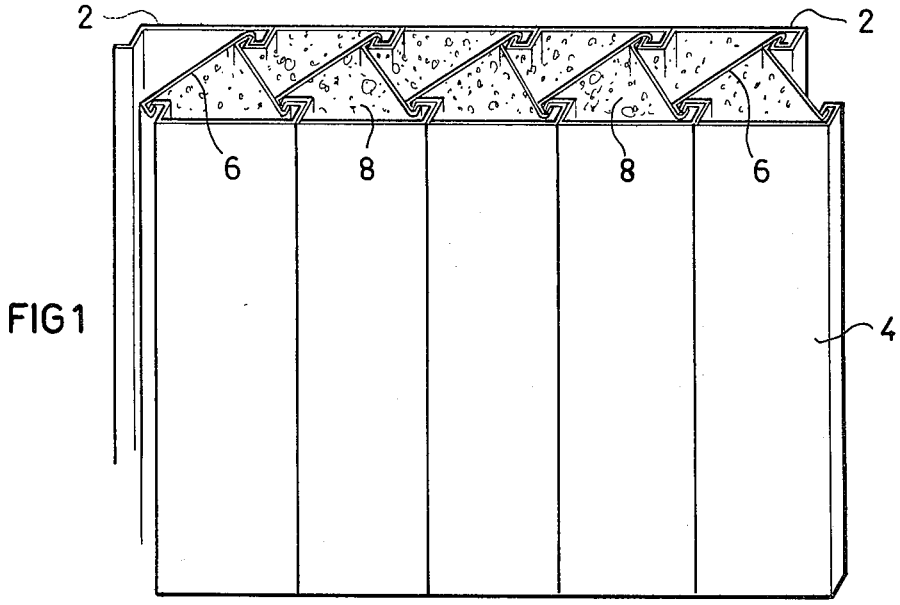
FIG. 1 is a three-dimensional view illustrating one form of protective wall structure constructed in accordance with the invention.
Figure 2:
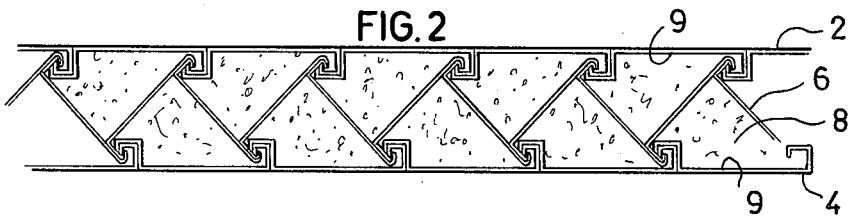
FIG. 2 is a top plan view of the wall structure of FIG. 1.

To facilitate assembling of the panels 2, 4 and 6, and to aid in retaining them in their assembled condition at the time of pouring the concrete, it is desirable to pass a rod, shown at 9 in FIG. 2, through the bent legs of each group of the face panels 2 and 4, between their planar sections and their outer free ends. Rods 9 may be located so as to engage, or be slightly spaced from, these free ends, and may be retained during the pouring of the concrete so as to become embedded therein.

A protective wall structure constructed as described above has been found to be very effective in withstanding blast and particularly fragments. Thus, fragments passing through one of the face panels 2, 4, intercept one of the diagonal panels and are deflected thereby towards the interlocking apex formed by the two adjacent diagonal panels, such that the deflection itself absorbs a considerable part of the fragment energy while the remaining energy is absorbed by the apex, this being reinforced by the interlocking of the diagonal panels and face panels. In addition, crumbling of the concrete 8 is minimized because of the back-up support provided by the diagonal panels 6, as well as by the face panels. Further, the illustrated protective wall structure can be produced much thinner than the conventional reinforced-concrete structures and at substantially lower cost than the "lacing steel" structures mentioned above.

FIGS. 7–12 illustrate some modifications. Thus, FIGS. 7 and 8 illustrate the invention being incorporated in a blast container, generally designated 100, wherein the inner face panels 102, outer face panels 104, and diagonal panels 106, are all in the same interlocking relationship as described above, except that they define a substantially cylindrical enclosure. The space between the face panels 102 and 104 is also filled with a filling material 108, preferably concrete or asphalt. Such a blast container may be erected and supported on a concrete foundation 110, including two annular grooves 112, 114 for receiving the face plates 102, 104, respectively.

FIGS. 10–12 illustrate a similar arrangement for supporting a straight protective wall, generally designated 200, on a concrete foundation 210, this protective wall also including interlocking face panels 202, 204, and diagonal panels 206, together with a concrete filling 208, the two face panels 202 and 204 being erected and supported in two parallel grooves 212, 214 formed in the concrete base 210, the latter including reinforcing rods 216 for connection to the wall structure.

While the invention has been described with respect to certain preferred embodiments, it will be appreciated that many other variations, modifications and applications of the invention may be made.

What is claimed is:

1. A protective wall structure having a high resistance to blast and fragments, characterized in that it includes;

two spaced groups of panels of rigid metal sheets, the sheets of each group having ends in interlocking relationship with the ends of the adjacent sheets of the respective group and defining therewith each of the two opposite faces of the wall structure, the interlocking ends of one group of face panels being non-aligned with the interlocking ends of the other groups of face panels;

a plurality of diagonal panels of rigid metal sheets extending diagonally between the face panels and having ends in interlocking relationship with each of the interlocking ends of the face panels;

and a filling material filling the space between the face panels and embedding the diagonal panels therein.

2. The wall structure according to claim 1, wherein said filling material is concrete or asphalt.

3. The wall structure according to claim 2, wherein said face panels are formed with stepped, inwardly-bent ends, which ends of adjacent panels are in nesting interlocking relationship with each other and with the ends of the diagonal panels.

4. The wall structure according to claim 3, wherein said diagonal panels are also formed with stepped ends and are disposed in a saw-tooth configuration coming together in nesting relationship with the stepped bent ends of the face panels.

5. The wall structure according to claim 4, wherein all said face panels are of the same configuration and include three right-angle bends at their opposite ends, with the bend at one end of each panel being slightly larger than that at the opposite end of the same panel, to permit one end of each panel to be nested within the opposite end of the adjacent panel.

6. The wall structure according to claim 6, wherein all said diagonal panels are of the same configuration, each including a single, acute-angle bend at one end, and a double bend at the opposite end, the inner bend of which forms an obtuse angle to the panel and the outer bend of which forms an acute angle to the inner bend.

7. The wall structure according to claim 1, wherein said diagonal panels are formed with openings to permit the passage therethrough of the filling material.

8. The wall structure according to claim 1, wherein said diagonal panels form equal angles to each other.

9. The wall structure according to claim 1, wherein the wall structure is of linear configuration.

10. The wall structure according to claim 1, wherein the wall structure is of curved configuration.

* * * * *